United States Patent [19]

Morris

[11] Patent Number: 4,923,412

[45] **Date of Patent: * May 8, 1990**

[54] TERMINAL END FOR COAXIAL CABLE

[75] Inventor: William E. Morris, Mesa, Ariz.

[73] Assignee: Pyramid Industries, Inc., Phoenix, Ariz.

[ * ] Notice: The portion of the term of this patent subsequent to Aug. 8, 2006 has been disclaimed.

[21] Appl. No.: 383,220

[22] Filed: Jul. 20, 1989

Related U.S. Application Data

[63] Continuation of Ser. No. 126,888, Nov. 30, 1987, Pat. No. 4,854,893.

[51] Int. Cl.[5] ..... H01R 17/18

[52] U.S. Cl. ..... 439/578

[58] Field of Search ..... 439/578–585

[56] References Cited

U.S. PATENT DOCUMENTS

| | | | |
|---|---|---|---|
| 3,526,871 | 9/1970 | Hobart | 339/177 |
| 3,671,926 | 6/1972 | Nepovim | 339/177 |
| 3,686,623 | 8/1972 | Nijman | 339/177 |
| 3,706,958 | 12/1972 | Blanchenot | 339/60 |
| 3,847,463 | 11/1974 | Hayward et al. | 439/578 |
| 3,854,789 | 12/1974 | Kaplan | 339/177 |
| 3,864,738 | 11/1975 | Nepovim | 339/60 |
| 4,346,958 | 8/1982 | Blanchard | 339/177 |
| 4,441,781 | 4/1984 | Forney, Jr. et al. | 339/177 |
| 4,447,107 | 5/1984 | Major, Jr. | 339/171 |
| 4,557,546 | 12/1985 | Dreyer | 339/177 |
| 4,575,274 | 3/1986 | Hayward | 403/2 |
| 4,583,811 | 4/1986 | McMills | 339/177 |
| 4,676,577 | 6/1987 | Szegda | 439/584 |
| 4,690,481 | 9/1987 | Randolph | 439/585 |
| 4,696,532 | 9/1987 | Mattis | 439/585 |
| 4,746,305 | 5/1988 | Nomura | 439/585 |

*Primary Examiner*—Joseph H. McGlynn

*Attorney, Agent, or Firm*—Cahill, Sutton & Thomas

[57] ABSTRACT

A two part coaxial cable connector includes a rear nut housing a ferrule for gripping the sheath of a coaxial cable and a front nut body for gripping the conductor upon threaded engagement of the rear and front nut bodies. A mandrel, located within and protected by the rear nut body, slides within the sheath upon feeding of the cable into the rear nut body. A pair of annular inclined surfaces or ramps compress the ferrule at opposed edges to squeeze the ferrule into gripping engagement with the sheath. Simultaneously, a collet in the front nut body is compressed to grip the conductor. To facilitate the feeding of a seamed or off round sheath, the ferrule, mandrel and associated parts float within the rear nut body. A positive visually apparent physical interference between the rear and front nut bodies prevents overtighting and resulting damage.

23 Claims, 2 Drawing Sheets

10
12
14
16
18
20
28
30
32
34
36
38
40
42
44
46
48
50
52
54
60
62
64
66
68
70
72

TERMINAL END FOR COAXIAL CABLE

This is a continuation of application Ser. No. 126,888 filed Nov. 30, 1987, now U.S. Pat. No. 4,854,893.

BACKGROUND OF THE INVENTION

1. Field of the Invention

The present invention relates to coaxial cable connectors and, more particularly, to a two part connector having a double action floating ferrule and a enclosed mandrel.

2. Description of Related Prior Art

Coaxial cables with which the present invention is used include a solid conductor of approximately one eighth inch diameter surrounded by a plastic or other non-rigid dielectric compound and encased within an electrically conducting generally metallic sheath of approximately one half inch diameter. Each and of a coaxial cable is terminated by a connector which serves the function of electrically engaging the conductor to transmit any signals transmitted therethrough and for gripping the sheath to physically secure the cable and prevent detachment during normal operation. Preferably, the sheath should be gripped firmly but without damage to preserve the integrity and strength provided by the sheath.

Numerous cable connectors have been developed for the purpose of terminating an end of a coaxial cable of the type described above. These connectors are representatively illustrated and described in the below identified U.S. Patents. U.S. Pat. Nos. 3,526,871, 3,671,926, 3,686,623, 3,706,958, 3,846,738 and 4,557,546 describe two-part connectors having a single ramp for compressing one end of a sheath gripping ferrule. U.S. Pat. No. 4,447,107 is directed to a connector having a cone shaped surface for squeezing a collet to grip the conductor of a cable. U.S. Pat. No. 4,346,958 is directed to a three part connector having an exposed mandrel. U.S. Pat. No. 4,575,274 illustrates and describes a two-part connector having an exposed mandrel extending from one part and a single ramp ferrule associated with the other part. U.S. Pat. No. 3,854,789 is directed to a two-part connector having a double action ferrule for gripping the sheath but does not include a mandrel for internally supporting the sheath. U.S. Pat. No. 4,676,577 illustrates a connector having a dual-ramped ferrule disposed in one part and an exposed mandrel extending from the other part. U.S. Pat. No. 4,583,811 is directed to the construction of a connector for a braided cable, sometimes referred to a drop line. U.S. Pat. No. 4,441,781 illustrates a three part connector. U.S. Pat. No. 4,690,481 is directed to a plug pin.

SUMMARY OF THE INVENTION

The present invention is directed to a two part connector for terminating the end of a coaxial cable. A split ferrule for gripping the sheath of the cable is floatingly mounted between a ring and a collar having annular ramps for exerting radially compressive forces upon opposed ends of the ferrule. A mandrel extends within the ferrule from the collar for supporting the interior cylindrical surface of the sheath upon compression of the ferrule. A collet for receiving and gripping the conductor is mounted within a cone of a seizing insulator, which insulator compresses the collet upon mating of the two parts of the connector. A shroud of one part of the connector mates with a annular shoulder of the other part to mechanically prevent overtighting and simultaneously provides a visual indication that the two parts have been secured to one another.

It is a primary object of the present invention to provide a coaxial cable connector having a pair of ramps for radially compressing opposed ends of a cable sheath gripping ferrule.

Another object of the present invention is to provide a floating ferrule assembly in a coaxial cable connector to accommodate cylindrical, seamed and non-cylindrical sheaths of a coaxial cable.

Yet another object of the present invention is to provide a visually apparent mechanical interference to prevent overtightening of a two part coaxial cable connector.

Still another object of the present invention is to provide a mandrel shielded within one part of a two-part coaxial cable connector.

A further object of the present invention is to provide a visually perceivable penetrable insertion of the conductor of a coaxial cable into a collet upon assembly of a two-part coaxial cable connector.

A still further object of the present invention is to provide a two-part coaxial cable connector having sheath engaging and retaining apparatus mounted in one part and conductor engaging and retaining apparatus mounted in the other part.

A yet further object of the present invention is to provide a self aligning, easy to use two-part coaxial cable connector.

A yet further object of the present invention is to provide a low cost, low parts count coaxial cable connector.

A yet further object of the present invention is to provide a method for terminating an end of a coaxial cable with a connector.

These and other objects of the present invention will become apparent to those skilled in the art as the description thereof proceeds.

DESCRIPTION OF THE PREFERRED EMBODIMENT

Figures 1, 2, 3:
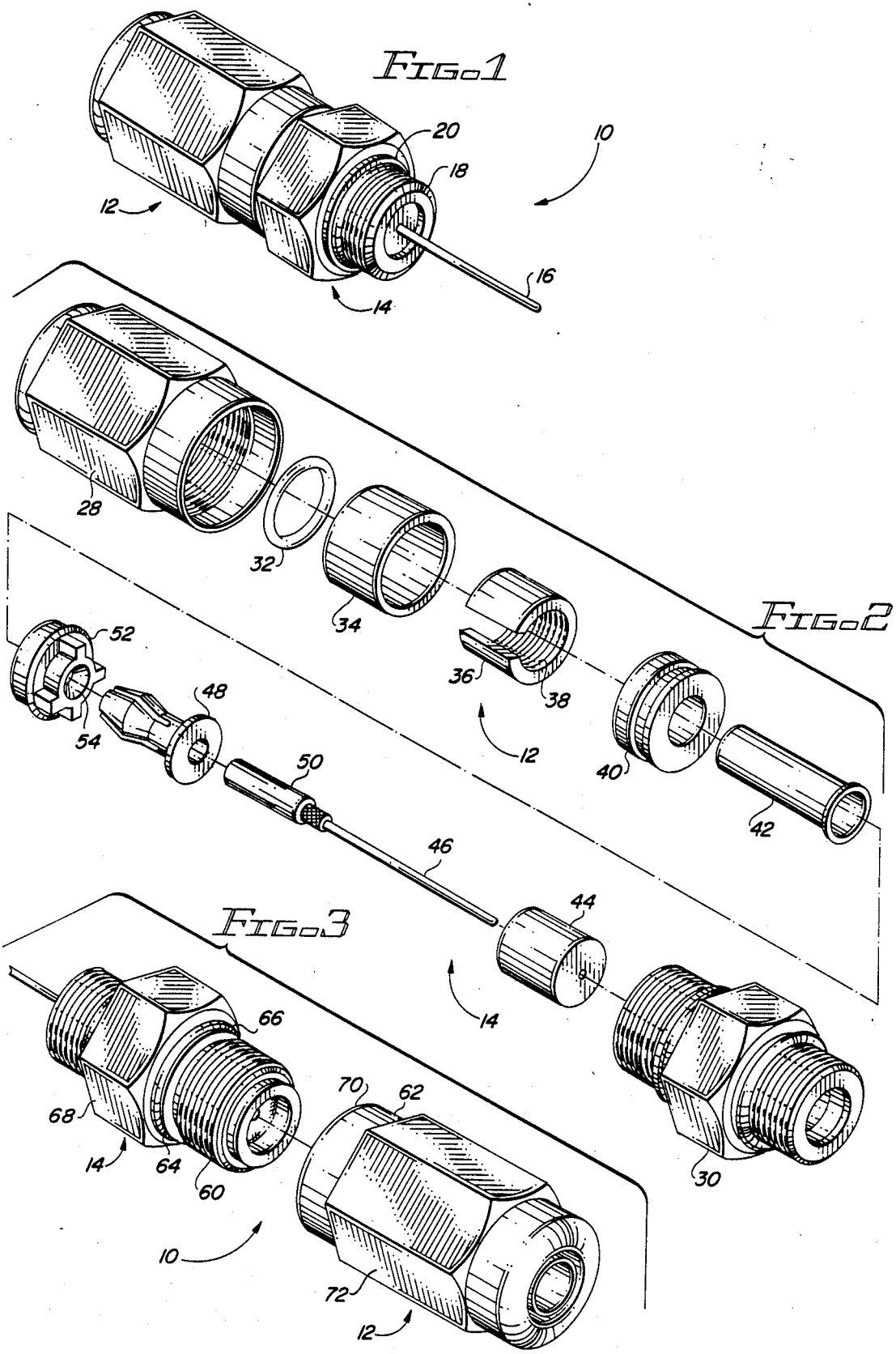
FIG. 1 is an isometric view of an assembled two-part coaxial cable connector constructed in accordance with the present invention.
FIG. 2 is an exploded view of the major components associated with each part of a two-part coaxial cable connector.
FIG. 3 is an isometric view of the two parts of a disassembled two-part coaxial cable connector.

Referring to FIG. 1, there is illustrated a two-part coaxial cable connector 10 in an assembled state. The connector includes a rear nut body 12 for receiving and terminating an end of a coaxial cable. Such cable may be of the type used for transmitting television signals (cable TV). Cable of this type includes a solid conductor of approximately one eighth inch diameter concentrically located within a metallic electrically conducting sheath of approximately one half inch diameter. A plastic or other dielectric non-rigid compound locates and maintains the conductor concentric with the sheath. A front nut body 14 mechanically and electrically engages the conductor of the cable and provides an electrical connection with an electrode, such as extending pin 16. The pin is penetrably insertable within a suitable coaxial receiver, socket or female end. The front nut body may include a threaded stud 18 for engaging a threaded cavity to mechanically secure connector 10 with the receiver of pin 16. O-ring 20 may be used to provide a weather and dust seal.

The upper part of FIG. 2 illustrates in exploded view of the major components located within housing 28 of rear nut body 12. The lower part of FIG. 2 illustrates the major components located within housing 30 of front nut body 14. With regard to rear nut body 12, an O-ring 32 circumscribingly engages the sheath of a cable inserted within rear nut body 12 to provide a weather seal between housing 28 and the cable. A ring 34 bears against O-ring 32 to establish the seal and provides a radially compressive forces upon one end of ferrule 36. The ferrule is split to permit its compression to exert a gripping force upon the sheath of the cable. A plurality of inwardly radially oriented ridges 38 are disposed within the ferrule to assist in frictionally gripping the sheath. A collar 40 exerts radially compressive force upon the other a nd of ferrule 36 to assist in having the ferrule frictionally grip the sheath of the cable. In addition, a mandrel 42 is secured to collar 40 for insertion within the sheath of the cable to provide an anvil against which the sheath is compressed by the ferrule.

With regard to front nut body 14, a cylindrical insulator 44 is lodged within housing 30 for mechanically supporting pin 46 which extends from front nut body 14. A collet 48 of dielectric material is mounted upon split end 50 of pin 46. A seizing insulator 52 includes a coned surface 54 for engaging and compressing or constricting collet 48 upon translatory movement of the seizing insulator toward the collet.

While FIG. 1 illustrates connector 10 in the assembled state, as seen from the pin end, FIG. 3 illustrates connector 10 in the disassembled state, as seen from the cable end. Front nut body 14 includes a hollow threaded stud 60 for threadedly receiving internally threaded shroud 62 of front nut body 12. An O-ring 64 is disposed at the base of stud 60 to engage the terminal end of the shroud and upon such engagement to provide a weather seal. A shoulder 66, formed as part of nut 68, creates a mechanical interference with edge 70 of shroud 62 upon assembly of the two parts of the connector to prevent further tightening and potential damage to the inner components or the terminal end of the gripped cable. Rear nut body 12 includes a nut 72 to assist in threadedly engaging and disengaging the rear nut body with front nut body.

The assembled components of rear nut body 12 and front nut body 14 will be described with primary reference to FIG. 4. Ring 34 includes an annular groove 80 for receive and retaining O-ring 32. The groove is configured to only partially receive the O-ring to force the latter to protrude past the respective end of the ring. Upon assembly of the rear nut body with the front nut body, the ring will be urged rearwardly with commensurate movement of O-ring 32. Such movement will bring the O-ring into compressive engagement with shoulder 82 of housing 28 to develop a seal. Simultaneously, the O-ring will be forced radially inwardly to compressively engage the outer surface of the sheath of the coaxial cable fed into housing 28 to provide an annular seal about the sheath. Ring 34 includes an annular ramp 84 for circumferentially engaging end 86 of split ferrule 36. The ramp will urge inward radial movement of end 86 of ferrule 36 to seize and compress the sheath of a cable fed into rear nut body 12 through aperture 114. Ferrule 36 is split, as defined by longitudinal edges 88, 90. A plurality of ridges 38 extend annularly within the ferrule to provide a gripping surface for frictionally engaging the outer surface of the sheath of a cable inserted within the nut body. It may ba nota d that ring 34 is generally located within an annularly expanded cavity 92 within housing 28.

Collar 40 includes a radially upwardly oriented groove 94 for receiving and loosely retaining a snap ring 96. The snap ring, in its normally extended state, extends radially beyond the perimeter of collar 40. A radially expanded cavity 98 is disposed within housing 28 to accommodate and receive snap ring 96 in its extended state. Opposed shoulders 100, 102 of cavity 98 restrict the movement of snap ring 96, and the engaged collar, along the longitudinal axes of rear nut body 12. To insert collar 40 within housing 28, snap ring 96 is compressed within groove 94 to an extent sufficient to permit passage past threads 104 within shroud portion 62 of housing 28. Collar 40 includes an annular ramp 106 for engaging end 108 of ferrule 36. Upon translational movement of collar 40 of ferrule 36, ramp 106 will circumferentially engage end 108 to urge inward radial movement of the end against the underlying sheath of a cable inserted within rear nut body 12.

Figure 4:
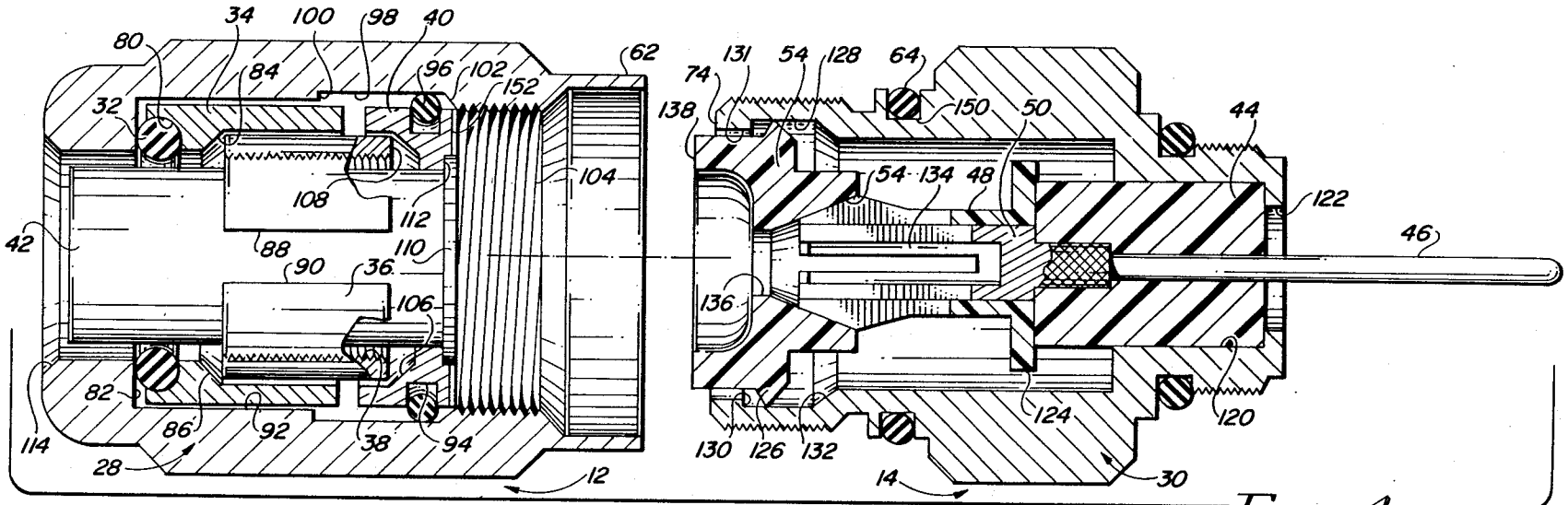
FIG. 4 is a cross sectional view of the two parts of a two-part coaxial cable connector in a disassembled state.

Upon reference to FIG. 4, it will be noted that a degree of clearance exists between ring 34 and the adjacent surfaces of housing 28 and ferrule 36. Similarly, a degree of clearance exists between collar 40 and the adjacent surfaces of housing 28, as well as with ferrule 36. With such clearances, ferrule 36 floats within the housing, by which term is meant that the ferrule is free to a limited degree to move longitudinally, laterally and angularly with respect to the longitudinal axes of rear nut body 12. Such limited freedom of movement permits the ferrule to accommodate receiving a seamed sheath of a cable, a somewhat distorted or deformed sheath of a cable or a noncircular sheath of a cable.

A mandrel 42 includes a radially expanded flange 110. Collar 40 includes an annular depression 112 for receiving flange 110. Preferably, the flange is friction fitted or otherwise mechanically secured within the depression to maintain mandrel 42 fixedly attached to collar 40. Mandrel 42 is slid interior of and adjacent to the sheath of a cable fed into the rear nut body to serve in the manner of an anvil against which the sheath can be compressed by ferrule 36. It may be noted by inspection that all of mandrel 42 is located within housing 28 which location permits the housing to serve as a protective barrier to prevent damage or distortion to the mandrel during handling of the rear nut body.

Insulator 44 is disposed within circular cavity 120 of housing 30. Pin 46, penetrably mounted within insulator 44, extends from the housing through aperture 122. Collet 48, mounted upon split end 50, includes a circular flange 124 to bear against the corresponding end of insulator 44. Seizing insulator 52 includes a compressible annular protrusion 126. The housing includes an expanded annular cavity 128 having shoulders 130, 132. Cavity 128 is diametrically sized to permit translatory movement of seizing insulator 52 along the longitudinal axes of housing 30 while shoulder 130 limits movement of the seizing insulator in a direction away from collet 48. Seizing insulator 52 is snap-fitted within annular cavity 128 by momentarily forcing the flexible and compressible protrusion 126 past aperture 131 defining shoulder 130. Cone 54 of the seizing insulator bears against commensurately angled surfaces of collet 48. Upon translatory motion of the seizing insulator toward collet 48, cone 54 will exert radially inwardly directed forces upon the collet to compress or constrict the collet. Compression of the collet will result in commensurate, radially inward movement of fingers 134 of split end 50. Upon insertion of a conductor within split end 50, the radial inward movement of fingers 134 will grip and frictionally retain the conductor to provide a good electrical contact therewith and a friction fit therebetween.

Prior to attachment of a coaxial cable with connector 10, the end of the cable must be dressed. Such dressing includes cutting back sheath 140 to expose a predetermined length of conductor 142 (see FIG. 5). Additional)y, dielectric compound 144, used to physically retain the conductor concentric with the sheath and electrically insulated therefrom, is removed for a distance along the cable at least equivalent to the length of mandrel 42.

Figure 5:
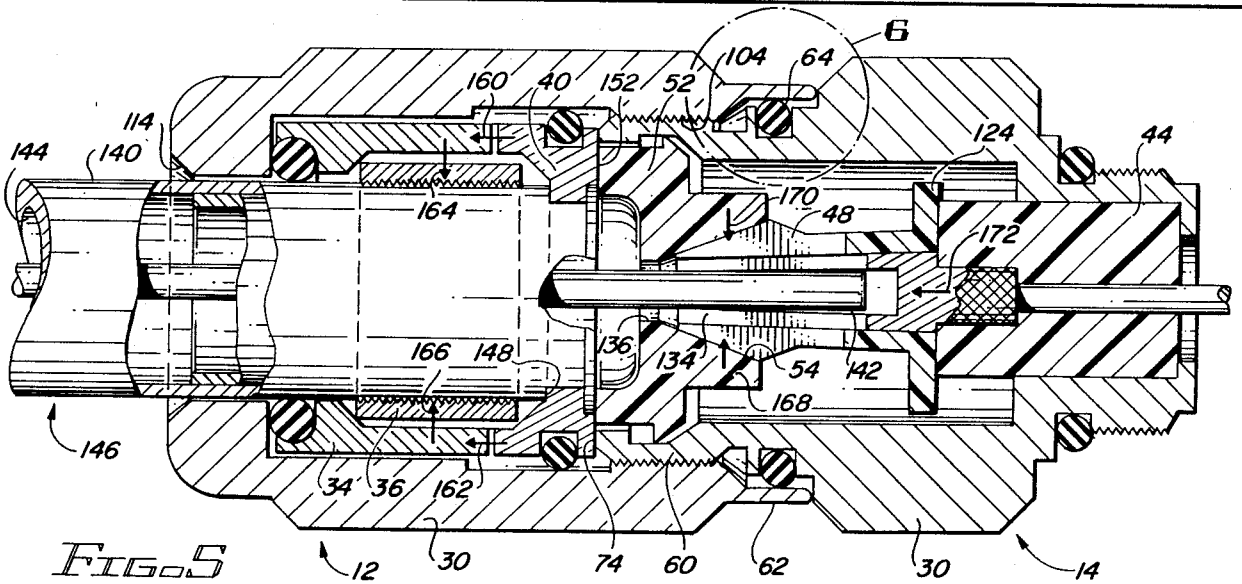
FIG. 5 is a cross sectional view of the two parts of a two-part coaxial cable connector in an assembled state.

Dressed cable end 146, as illustrated in FIG. 5, is fed through aperture 114 of housing 28 to circumscribingly receive mandrel 42 until edge 148 of sheath 140 bears against collar 40. Simultaneously, the sheath will be inserted within ferrule 36. Any distortion of the sheath or non-circular cross section of the sheath, as well as a seam of a sheath, will be readily accommodated by the ferrule due to its floating relationship within housing 28.

After dressed cable end 146 has been fed into rear nut body 12, front nut body 14 is attached to the rear nut body. Threaded stud 60 of the front nut body is penetrably inserted within shroud 62 into threaded engagement with threads 104. Simultaneously conductor 142 is penetrably inserted through aperture 136 of seizing insulator 52 and into the cavity defined by fingers 134 of split end 50. This insertion of the conductor is visually apparent to a user of connector 10. Shroud 62 circumscribingly engages and compresses O-ring 64 located in annular slot 150. End 138 of seizing insulator 52 bears against side wall 152 of collar 40. Moreover, end 74 of stud 60 bears against side wall 152 of collar 40.

Upon further threaded engagement between rear nut body 12 and front nut body 14, several events occur simultaneously. End 138, bearing against side wall 152 of collar 40, will result in translatory movement of the collar toward ring 34, as depicted by arrows 160, 162. Movement of the collar will produce translatory movement of ferrule 36 via ramp 106. Movement of the ferrule will produce translatory movement of ring 34 via ramp 84. The movement of the ring is limited by shoulder 82. Thereafter, as the collar continues to move toward the ring, as depicted by arrows 160. 162, inclined ramps 84, 106 bear against corresponding ends of ferrule 36 to radially compress the ferrule, as depicted by arrows 164, 166. The compression of the ferrule will tend to exert a compressive force upon sheath 140, which force is resisted by the support provided by underlying mandrel 42. The likelihood of deformation, destructive distortion or mechanical damage with resulting reduced integrity of the sheath is reduced or avoided by the mandrel.

Collar 40, via sidewall 152, exerts a force upon end 138 of seizing insulator 52 which results in translatory motion toward pin 46. The translatory motion causes cone 54 to exert a compressive force upon collet 48, as represented by arrows 168, 170. Translatory motion of the collet is resisted by insulator 44 bearing against circular flange 124, as represented by arrow 172.

Figure 6:
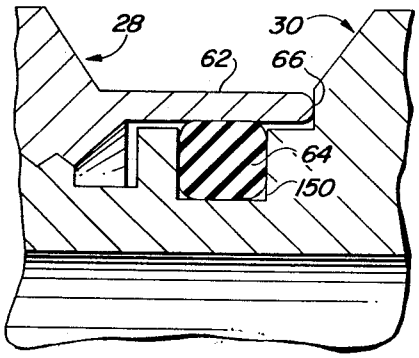
FIG. 6 is a partial cross sectional view taken as illustrated in FIG. 5.

To prevent overtightening, with potential damage to the components of connector 10, a visual indication of adequate tightening, as well as a mechanical stop against further tightening is employed in connector 10, as particularly illustrated in FIG. 6. With appropriate dimensioning of the longitudinal length of shroud 62, it will bear against shoulder 66 when ferrule 36 has been radially inwardly compressed a sufficient degree through movement of collar 40 to securely grip sheath 140. Without the mechanical stop to prevent further intrusion of threaded stud 60 into the rear nut body, damage to the internal components of the connector, or the connected cable would occur. By providing the mechanical stop at the external surface of the connector in such a manner as to render the mechanical stop visually evident, the likelihood of a workman overtightening the connector is reduced. Thus, actual or potential damage to connector 10 is lessened by incorporating a mechanical stop of the type illustrated in FIG. 6.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environment and operating requirements without departing from those principles.

I claim:

1. A coaxial cable connector having two threadedly engageable parts for terminating an end of a coaxial cable having a sheath and a conductor, said connector comprising in combination:

(a) a first part comprising a rear nut body for receiving and gripping the sheath of the coaxial cable, said nut body including
  (1) a ferrule disposed within said rear nut body for at least partially circumscribing the sheath, said ferrule including means for at least axially floating said ferrule relative to said near nut body upon engaging the cable with said rear nut body:
  (2) ramp means for radially inwardly compressing at least a segment of said ferrule;
  (3) a mandrel for penetrating the cable adjacent the inner surface of the sheath in juxtaposed relationship with said ferrule;

(b) a second part comprising a front nut body for receiving the conductor of the coaxial cable;

(c) means for axially translating said ramp means and said ferrule relative to one another upon threaded engagement of said rear nut body and said front nut body to compress at least a segment of said ferrule; and (d) visually perceivable means for limiting the extent of threaded engagement between said rear nut body and said front nut body.

2. The connector as set forth in claim 1 wherein said rear nut body includes a collar for defining said ramp means.

3. The connector as set forth in claim 1 wherein said rear nut body includes an annularly expanded section for receiving said ramp means and, said ferrule while accommodating movement therebetween.

4. The connector as set forth in claim 3 including means for retaining said ramp means and said ferrule within said annular cavity.

5. The connector as set forth in claim 1 wherein said rear nut body includes a ring for defining said ramp means.

6. The connector as set forth in claim 5 including means for securing said mandrel with said collar to positionally support said mandrel interior of said ferrule.

7. The connector as set forth in claim 6 wherein said mandrel is contained within said rear nut body.

8. The connector as set forth in claim 1 wherein said front nut body includes a collet for imposing a gripping force upon the conductor and a seizing insulator for constricting said collet.

9. The connector as set forth in claim 8 wherein said front nut body includes an electrode having a split end for receiving the conductor and wherein said split end is insertable within said collet.

10. The connector as set forth in claim 9 wherein said electrode comprises a pin extending from said front nut body.

11. The connector as set forth in claim 8 wherein said seizing insulator includes an aperture for penetrably receiving the conductor.

12. The connector as set forth in claim 11 wherein penetration of the conductor into the aperture of said seizing insulator is visually perceivable upon assembly of said first and second parts.

13. The connector as set forth in claim 12 including means for urging said ferrule toward said collar to radially compress an end of said ferrule upon assembly of said rear nut body with said front nut body.

14. The connector as set forth in claim 1 wherein said ferrule is at least longitudinally repositionable within said rear nut body prior to feeding of the coaxial cable into said rear nut body.

15. The connector as set forth in claim 14 including a collar disposed within said rear nut body for supporting said ramp means adjacent one end of said ferrule.

16. The connector as set forth in claim 15 including means for retaining said collar and said ferrule within said rear nut body.

17. The connector as set forth in claim 16 wherein said retaining means comprises a snap ring.

18. A method for terminating a dressed end of a coaxial cable having a sheath and a conductor with a coaxial cable connector having a rear nut body threadedly engageable with a front nut body, said method comprising the steps of:

(a) feeding the dressed end into the rear nut body and through an at least axially floating ferrule retained within the rear nut body;

(b) axially realigning the ferrule during said step of feeding to facilitate penetrating engagement by the cable sheath;

(c) inserting in circumscribed relationship a mandrel located in the rear nut body within the sheath in juxtaposed relationship with the ferrule during exercise of said step of feeding;

(d) threadedly engaging the rear nut body with the front nut body;

(e) radially inwardly compressing opposed ends of the ferrule to grip the sheath during exercise of said step of threadedly engaging; and (f) limiting with a mechanical stop the extent of threaded engagement between the rear nut body and the front nut body.

19. The method as set forth in claim 18 wherein said step of compressing includes the step of urging movement of at least one ramp against one end of the ferrule.

20. The method as set forth in claim 18 wherein said step of compressing includes the step of axially floating the ferrule within the rear nut body upon exercise of said step of feeding.

21. The method as set forth in claim 18 including the step of locating the conductor within a collet in the front nut body during said step of threadedly engaging and wherein said step of compressing includes the step of providing a visual indication of penetration of the conductor into the collet upon exercise of said step of locating.

22. The method as set forth in claim 18 wherein said step of compressing includes the step of maintaining the mandrel within the rear nut body prior to and subsequent to exercise of said steps of inserting and compressing.

23. The method as set forth in claim 18 wherein said steps of compressing is exercised during said step of threadedly engaging.

* * * * *